US005542667A

United States Patent [19]

Lezdey et al.

[11] Patent Number: 5,542,667

[45] Date of Patent: Aug. 6, 1996

[54] MARTIAL ARTS TRAINING DEVICE

[76] Inventors: Jarett R. Lezdey; Darren B. Lezdey, both of 701 Haddon Ave., Collingswood, N.J. 08108; Joseph G. Schneeweiss, 2551 Forest Run Ct., Clearwater, Fla. 34621

[21] Appl. No.: 436,128

[22] Filed: May 8, 1995

[51] Int. Cl.[6] ..... A63B 69/00

[52] U.S. Cl. ..... 273/84 R; 273/129 T; 482/12; 482/84

[58] Field of Search ..... 273/129 R, 129 T, 273/84 R, 84 ES, 26 B, 57.3; 473/45, 48; 482/12, 83, 84

[56] References Cited

U.S. PATENT DOCUMENTS

| | | | |
|---|---|---|---|
| 3,125,287 | 3/1964 | Roehm | 273/84 R |
| 3,662,080 | 5/1972 | Hale et al. | 273/84 R |
| 4,254,951 | 3/1981 | De Laney | 273/57.3 |
| 4,892,303 | 1/1990 | Lohre | 273/57.3 |

OTHER PUBLICATIONS

Martial Arts Supplies Company, "Rubber Weapons", 1978 Catalogue.

*Primary Examiner*—William M. Pierce
*Attorney, Agent, or Firm*—John Lezdey

[57] ABSTRACT

A martial arts training device for practicing hand and foot strikes. The device has a striking pole with a cushioned end and intermediate portion which is propelled by one hand through a hand grip.

8 Claims, 1 Drawing Sheet

MARTIAL ARTS TRAINING DEVICE

FIELD OF THE INVENTION

The present invention provides a training device for martial art sports including boxing. More particularly, there is provided a training device which can be used to practice offensive and defensive maneuvers.

BACKGROUND OF THE INVENTION

Poles with cushioned ends are well-known in jousting sports wherein the object of the sport is to strike an opponent to make him unbalanced.

Similar poles have been utilized in martial arts to practice techniques of defense. However, the attack is usually anticipated because movement of both arms is required.

It is therefore desirable to provide a pole-type of cushioned training object which can be used by both sexes and young martial art students who are less coordinated.

SUMMARY OF THE INVENTION

According to the invention, there is provided a martial arts training device which is at least three feet long so as to be used for both arm and foot strike practice. The device comprises a pole-like elongated member having on an end a cushion member for use to strike at a person practicing martial arts. Adjacent the cushion end member along a portion of the elongated member is a second cushion member. Between the other end of the elongated member and the second cushion means is a slidable grip member.

The grip member is an essential component of the present invention which provides the speed in use of the device.

It is therefore a general object of the invention to provide a martial arts training device.

It is a further object of the invention to provide a martial arts training device which can be used by many persons.

It is another object of the invention to provide a martial arts having a strike indicator.

These and other objects and advantages will become more apparent from the following description and the accompanying drawings.

DESCRIPTION OF THE PREFERRED EMBODIMENTS

Figure 1:
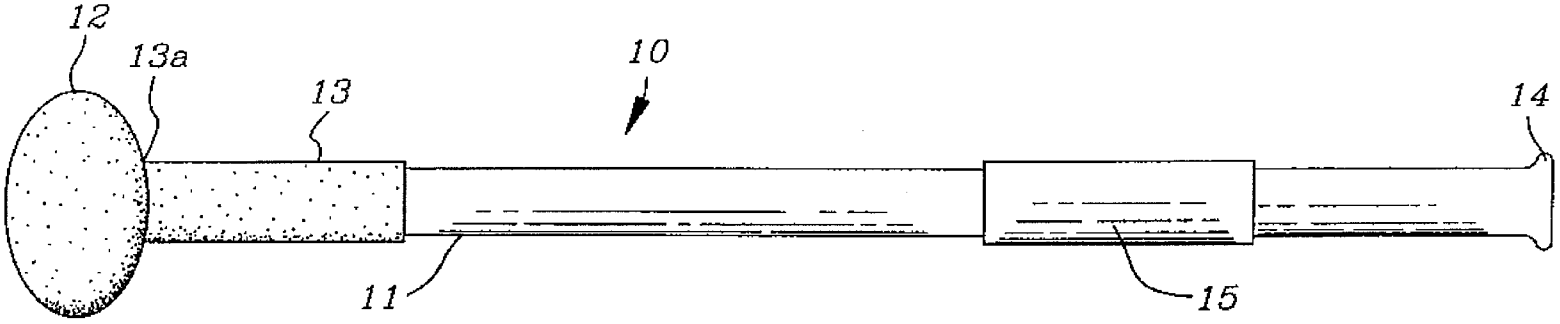
FIG. 1 is a side view of a martial arts device of the invention.

As shown in FIG. 1 the training device 10 of the present invention has a pole-like cylindrical member 11 at one end 13*a* is a striking cushion member 12. Adjacent cushion member 12 is another cushion member or wrap 13 which is along the cylindrical member 11. Between cushion 12 and end 14 of the cylindrical member 11 is a hand grip 15 which slides along the cylindrical member 11. Advantageously, the end 14 is a stop for the hand grip.

Figure 2:
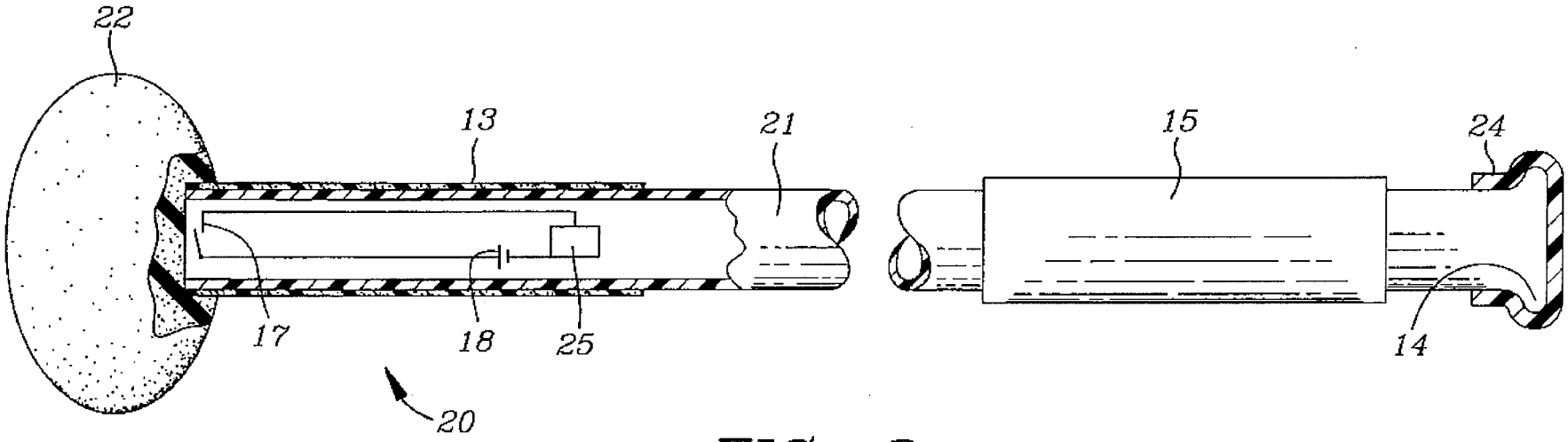
FIG. 2 is a side view taken in part of another embodiment of the invention.

FIG. 2 shows another embodiment of the invention. FIG. 2 shows a training device 20 which comprises a hollow elongated member 21. At the front end of the elongated member 21 is a striking cushion 22. The striking cushion 22 is associated with an electrical system containing a contact switch 17 which is normally in an open position, a battery 18 and an electric horn or sounding device 25. When the striking cushion 22 hits an object it will close the contact switch 17 to complete the circuit so that the horn 25 will sound.

Optionally, there is provided a cushion member over the end 14 so that the device can be used to attack from either end.

To use the training device of the invention, a trainee is confronted by the instructor who holds the training device by gripping the hand grip with one hand and the elongated member about the end. The instruction then uses a single hand to move the elongated member forward so that the trainee avoids and strikes at the training device utilizing the appropriate moves.

The elongated member can be made of any light weight material such as wood, plastic, for example, polyvinyl chloride, aluminum, or the like. Preferably, the metal and plastic members are hollow so as to be light weight. The length of the elongated member depends on the persons or activity for its use. Generally, about three to six feet is suitable. Preferably, about five to six feet in length is suitable to practice hand strikes and kicks.

The cushion members can be made from any impact deadening material such as foam (polyurethane), rubber, fabric, or the like. The wrap around the elongated member may comprise similar material as the cushion members and is usually about 2–3 feet along the elongated member.

The hand grip can be any type of cylindrical member which is composed of metal, plastic or rubber.

Various changes and modifications may be made in practicing the invention without departing from the spirit and scope thereof, and, therefore, the invention is not to be limited except as defined in the appended claims.

What is claimed is:

1. A martial arts training device for a person practicing defensive movements comprising:

A. an elongated cylindrical member which is at least three feet long;

B. a first cushion member at one end of said cylindrical member which is a strike member to be avoided by said person;

C. a second cushion member over said cylindrical member adjacent said first cushion member for practicing hand and foot strikes by said person; and D. a slidable grip means mounted on said cylindrical member between said cushion members and the other end for movement of the cylindrical member forward and back.

2. The training device of claim 1 including a stop means for said slidable grip means at another end of said elongated member.

3. The training device of claim 1 wherein said elongated member is between about three and six feet.

4. The training device of claim 1 wherein said elongated member is hollow.

5. The training device of claim 1 wherein said second cushion member is about one to three feet along said elongated member.

6. The training device of claim 1 including a third cushion member at another end of said elongated member.

7. The training device of claim 1 wherein said first cushion means contains a strike indicator means.

8. The training device of claim 7 wherein said indicator means provides a sound.

* * * * *